US006386843B1

(12) United States Patent
Umeda et al.

(10) Patent No.: US 6,386,843 B1
(45) Date of Patent: May 14, 2002

(54) HOUSING FOR FAN UNITS, AND ELECTRICAL APPARATUS USING A FAN UNIT

(75) Inventors: Fumihiro Umeda; Shinji Takemoto, both of Yonago (JP)

(73) Assignee: Nidec Corporation (JP)

( * ) Notice: Subject to any disclaimer, the term of this patent is extended or adjusted under 35 U.S.C. 154(b) by 0 days.

(21) Appl. No.: 09/606,456

(22) Filed: Jun. 29, 2000

(30) Foreign Application Priority Data

Dec. 9, 1999 (JP) ..... 11-349654
May 18, 2000 (JP) ..... 2000-145811

(51) Int. Cl.[7] ..... F04B 35/04

(52) U.S. Cl. ..... 417/423.14; 361/695; 415/220; 415/223

(58) Field of Search ..... 417/423.14, 423.15; 361/695; 415/173.1, 220, 223, 208.1, 211.1

(56) References Cited

U.S. PATENT DOCUMENTS 4,373,861 A 2/1983 Papst et al. ..... 415/213
6,010,318 A 1/2000 Li ..... 417/423.13
6,045,327 A * 4/2000 Amr ..... 415/211.2
6,099,247 A * 8/2000 Nishio ..... 415/173.1
6,193,478 B1 * 2/2001 Lin et al. ..... 417/423.15
6,238,181 B1 * 5/2001 Chen ..... 415/175
6,254,342 B1 * 7/2001 Fujinaka et al. ..... 415/208.5

* cited by examiner

*Primary Examiner*—Charles G. Freay
(74) *Attorney, Agent, or Firm*—Cummings & Lockwood

(57) ABSTRACT

A housing for a fan unit has a opening defined by an inner peripheral wall being formed with an expanded section for enlarging a part of the opening so that the speed of the air flowing from a predetermined direction and into the opening is higher than the speed of the air flowing from other directions. Since a part of the opening is enlarged, the flowing resistance of the airflow at the portion provided with the expanded section is low as compared with that at other portions. Therefore, the airflow speed increases for the air flowing from a predetermined direction in the electrical apparatus toward the air inlet of the fan unit, and a larger volume of air is thereby drawn into the air passage and is efficiently exhausted.

19 Claims, 7 Drawing Sheets

Prior Art

Prior Art

HOUSING FOR FAN UNITS, AND ELECTRICAL APPARATUS USING A FAN UNIT

BACKGROUND OF THE INVENTION

1. Field of the Invention

The present invention relates to housings for fan units, wherein the housings support a fan motor and define an air passage for guiding airflow induced by rotation of the fan motor. More particularly, the present invention relates to housings for fan units used for cooling central processing units ("CPUs"), circuit boards, and other electrical components disposed inside electrical apparatus, such as a personal computer or the like. The present invention also relates to an electrical apparatus using a fan unit for cooling CPUs, circuit boards, and other electrical components disposed therein.

2. Description of the Related Art

In electric apparatus, such as personal computers and game devices, fan units for exchanging air inside and outside the apparatus are used to cool CPUs, circuit boards, and other electrical components disposed inside the apparatus. One such motor is disclosed in U.S. Pat. No. 6,010,318.

FIGS. 1 and 2 show an example of a conventional fan unit 1 composed of a housing 5 and a fan motor 4. The fan motor 4 is supported by a plurality of supporting arms (not shown) extended from the housing 5, and an impeller 3 rotates about a rotational axis of the fan motor 4. As shown best in FIG. 2, the housing 5 includes a cylindrical section 5*h* and an air passage 5*a* defined by an inner peripheral wall of the cylindrical section 5*h*. The fan motor 4 is positioned within the air passage 5*a* by the supporting arms. A first flange 5*g*1 and a second flange 5*g*2, each having a rectangular planar shape, are each provided on a respective end of the cylindrical section 5*h*. One opening of the air passage 5*a* is defined as an air inlet 5*b* on the side of the first flange 5*g*1, and the other opening of the air passage 5*a* is defined as an air outlet (not shown) on the side of the second flange 5*g*2. Airflow induced by rotation of the impeller 3 of the fan motor 4 is guided from the air inlet 5*b* to the air outlet through the air passage 5*a*. The inner peripheral wall of the cylindrical section 5*h* has a tapered portion 5*d* provided at the opening on the side of the air inlet 5*b*, so that the airflow induced by rotation of the Impeller 3 can flow smoothly toward the inside of the air passage 5*a*. A plurality of screw holes 5*c* are formed on each of corners of the first and second flanges 5*g*1 and 5*g*2 so that screws (not shown) for mounting the fan unit 1 to a casing of an electrical apparatus, such as a personal computer, can be inserted therein.

The inside of the electrical apparatus upon which the fan unit 1 is mounted is heated to high temperatures by heat generated by the electrical components disposed therein, such as the CPU. In order to exhaust the heated air from the inside to the outside of the apparatus, the air inlet 5*b* faces the inside of the apparatus, and the air outlet is open to the outside of the apparatus. Thus, he heated air inside the electrical apparatus is exhausted to the outside by the fan unit 1 to thereby cool the electrical components disposed in the electrical apparatus.

It has become increasingly important for electrical apparatus, such as personal computers, to be more compact in size and to have lower power consumption. On the other hand, the performance of the electrical components used in these electrical apparatus, such as CPUs and the like, have been improved, and these components thereby tend to generate more heat. With the size reduction of the electrical apparatus, the spaces between the electrical components inside the electrical apparatus have been reduced, and as a result, the electrical components are more compactly and complexly arranged. As a result, the flow of air within the interior of the electrical apparatus is obstructed and the electrical components cannot be sufficiently cooled, thereby causing degradation of performance, such as calculation or processing speed, or resulting in breakdown of the electrical apparatus.

One approach to solving this problem has been to attempt to increase the size or rotational speed of the fan unit 1 to thereby increase the volume of airflow induced by the impeller 3. It has proven to be difficult to achieve this objective, however, due to the aforementioned requirements of reducing the size and power consumption of the electrical apparatus.

SUMMARY OF THE INVENTION

Accordingly, it is an object of the present invention to provide a housing for a fan unit having relatively high cooling efficiency.

It is another object of the present invention to provide a housing for a fan unit in which sufficient cooling performance can be obtained.

It is a further object of the present invention to provide a housing for a fan unit in which sufficient cooling performance can be obtained without increasing the size of the fan unit or the rotational speed of the fan motor.

It is a still further object of the present invention to provide a housing for a fan unit in which the direction of airflow induced by the rotation of the fan motor can be controlled.

It is another object of the present invention to provide an electrical apparatus wherein the interior of the apparatus is efficiently cooled by a fan unit.

It is still another object of the present invention to provide an electrical apparatus which achieves both stable operation and sufficient cooling of the electrical components disposed therein.

It is a further object of the present invention to provide an electrical apparatus in which the direction of airflow generated by a fan unit can be controlled.

In one aspect of the present invention, a housing for a fan unit includes an opening defined by an inner peripheral wall formed with an expanded section for enlarging a part of the opening in the radial direction with respect to the rotational axis of the fan motor, so that the speed of air flowing from a predetermined direction into the opening is higher than the speed of air flowing into the opening from other directions. Since a part of the opening is enlarged, the resistance to airflow at the expanded section of the opening is relatively low in comparison to other portions of the opening. Therefore, the airflow speed increases for the air flowing in the electrical apparatus from a predetermined direction toward the air inlet of the fan unit. As a result, a larger volume of air is thereby drawn into the air passage and is efficiently exhausted. By providing the expanded section at a position where electrical components having large heating values are disposed, such as a CPU or the like, a larger volume of air is drawn into the air passage from the region or side of the electrical components in comparison to the other regions or side of the apparatus and, in turn, is exhausted to the outside of the electrical apparatus. As a result, the inside of the electrical apparatus can be efficiently cooled without increasing the size of the fan unit or the rotational speed of the fan motor.

The expanded section may be defined by partially extending a tapered portion formed on either the air inlet or the air outlet side of the inner peripheral wall.

The foregoing and other objects, features, aspects and advantages of the present invention will become readily apparent from the following detailed description of preferred embodiments and accompanying drawings.

DETAILED DESCRIPTION OF THE PREFERRED EMBODIMENTS

Embodiments of the present invention will now be described with reference to the drawings.

FIGS. 3 to 6 show a housing for a fan unit according to a first embodiment of the present invention, and the fan unit employing the housing.

Figure 1:
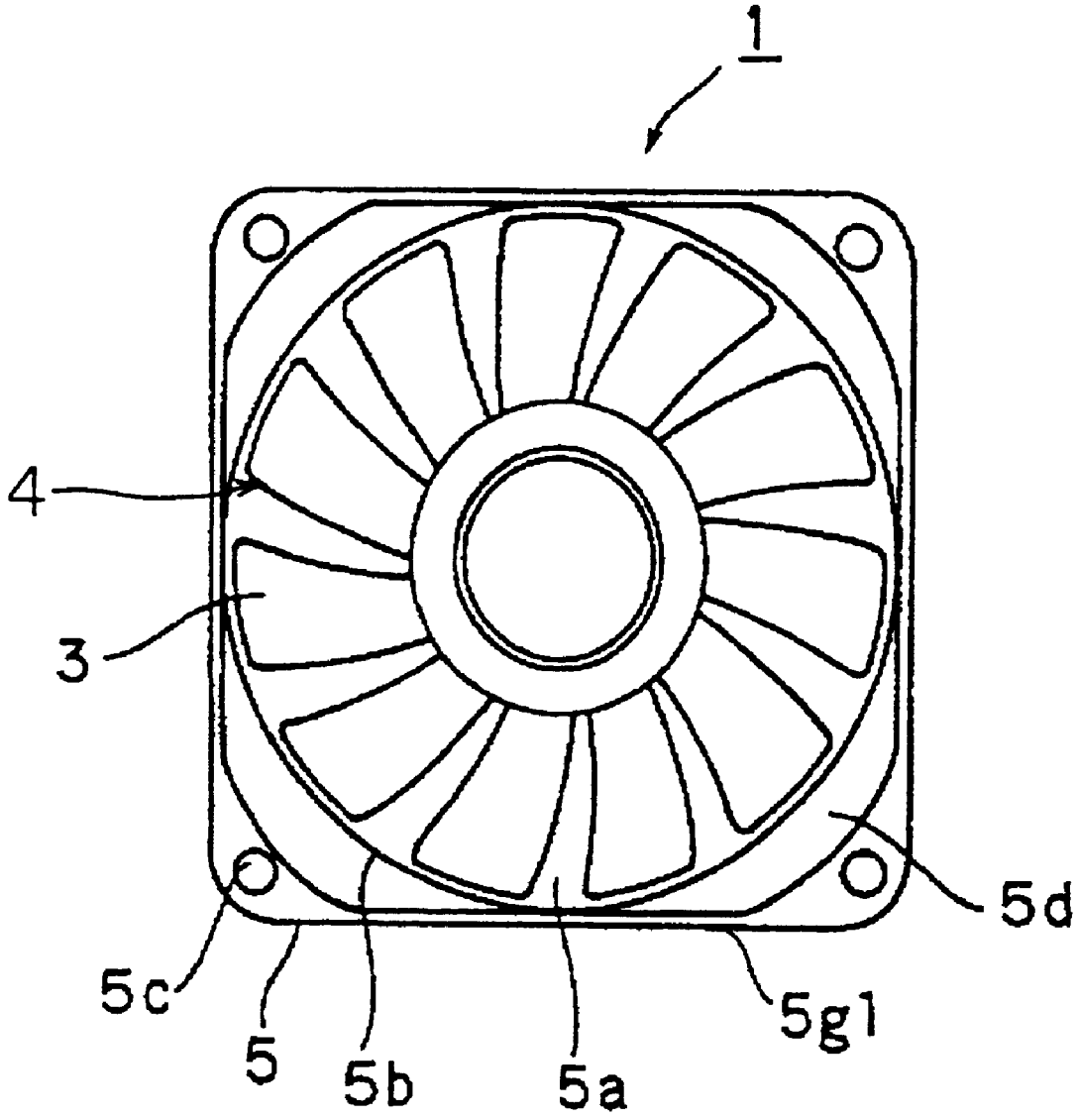
FIG. 1 is a front elevational view of a prior art fan unit having a conventional housing.
Figure 2:
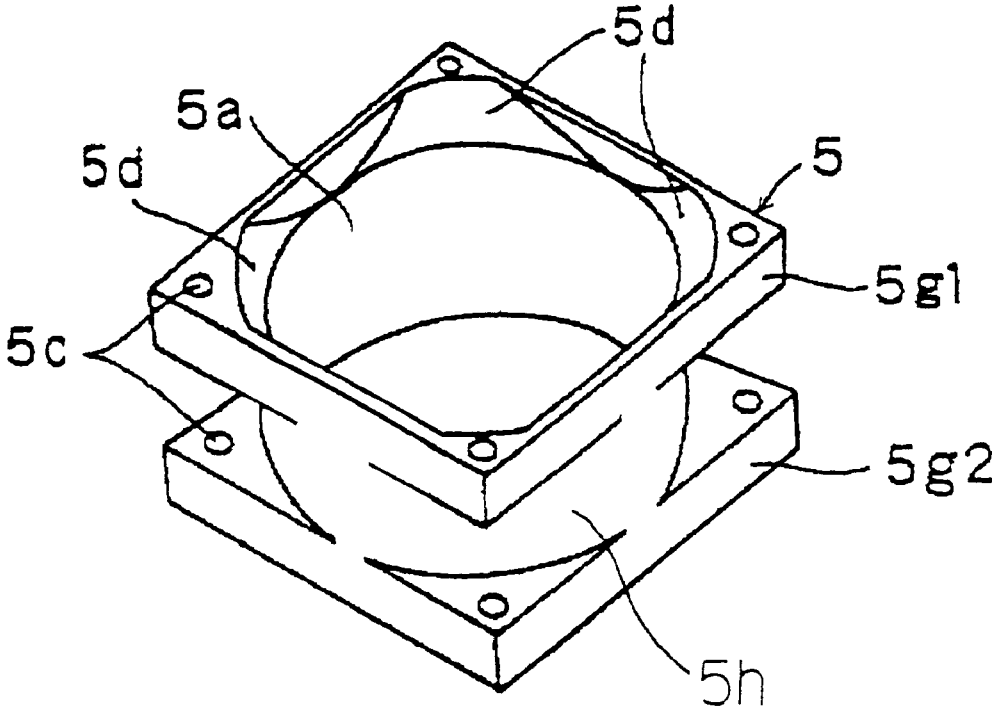
FIG. 2 is a perspective view of the conventional housing of the prior art fan unit of FIG. 1.
Figure 3:
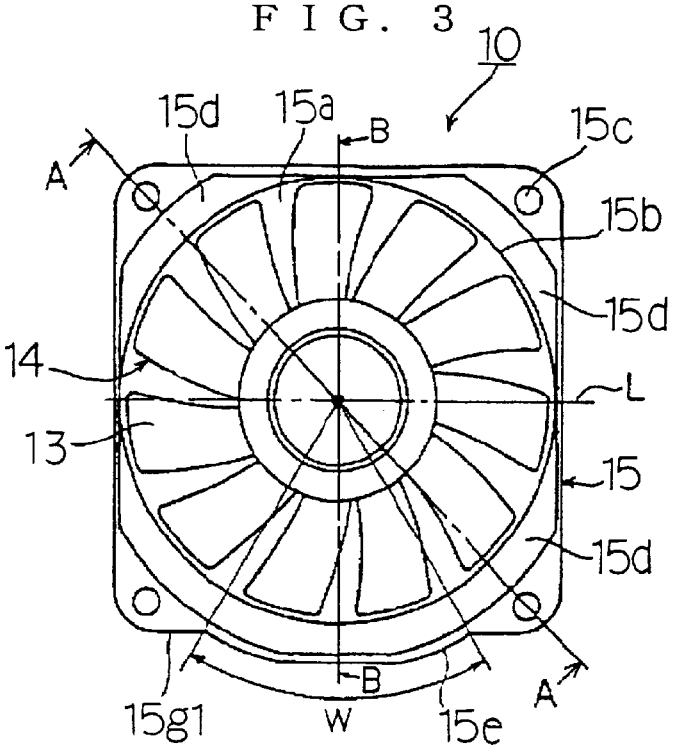
FIG. 3 is a front elevational view of a fan unit employing a housing according to a first embodiment of the present invention.
Figure 4:
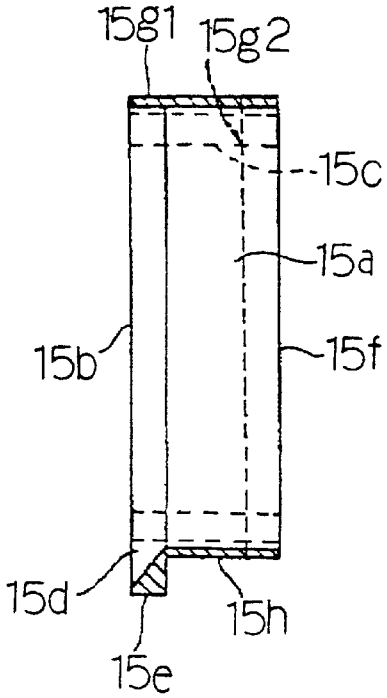
FIG. 4 is a cross-sectional view taken along the line B—B of FIG. 3.
Figure 5:
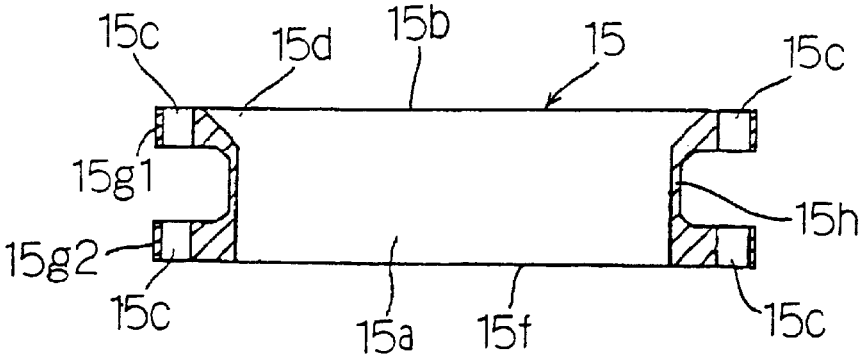
FIG. 5 is a cross-sectional view taken along the line A—A of FIG. 3.

As shown in FIG. 3, a fan unit 10 comprises a housing 15 having a rectangular planar shape, and a fan motor 14 supported by the housing 15. The housing 15 is integrally molded of a resin material of a type known to those of ordinary skill in the pertinent art, and includes a cylindrical section 15*h*, an air passage 15*a* defined by an inner peripheral wall of the cylindrical section 15*h*, and a first flange 15*g*1 and a second flange 15*g*2, each having a rectangular planar shape, and each being provided on a respective end of the cylindrical section 15*h*. An opening of the air passage 15*a* on the side of the first flange 15*g*1 serves as an air inlet 15*b*, and an opening on the side of the second flange 15*g*2 serves as an air outlet 15*f*. The fan motor 14 is disposed within the air passage 15*a* by a plurality of supporting arms, and includes an impeller 13 that is integrally rotated with the fan motor 14 about its rotational axis. The supporting arms may be in the shape of the arms 15*i* shown in FIG. 8.

A plurality of screw holes 15*c* are formed on each of the corners of the first and second flanges 15*g*1 and 15*g*2 so that screws for mounting the fan unit 10 to a casing of an electrical apparatus, such as a personal computer, can be inserted therein. When the impeller 13 of the fan motor 14 is rotated, airflow toward the air inlet 15*b* is induced in an electrical apparatus having the fan unit 10 mounted thereon, and the air is then exhausted through the air passage 15*a* and air outlet 15*f* to the outside of the electrical apparatus.

The frame of the housing 15 defining the opening of the air inlet 15*b* on the side of the first flange 15*g*1 is provided with a tapered portion 15*d* so that the radius of the air passage 15*a* is enlarged at the tapered portion 15*d* toward the end of the air inlet 15*b*, and the area of the air inlet 15*b* of the air passage 15*a* is correspondingly enlarged. The tapered portion 15*d* allows the air flowing from the inside of the electrical apparatus toward the air inlet 15*b* to be smoothly drawn into the air passage 15*a*. As a result, exhaust efficiency is improved.

Figure 6:
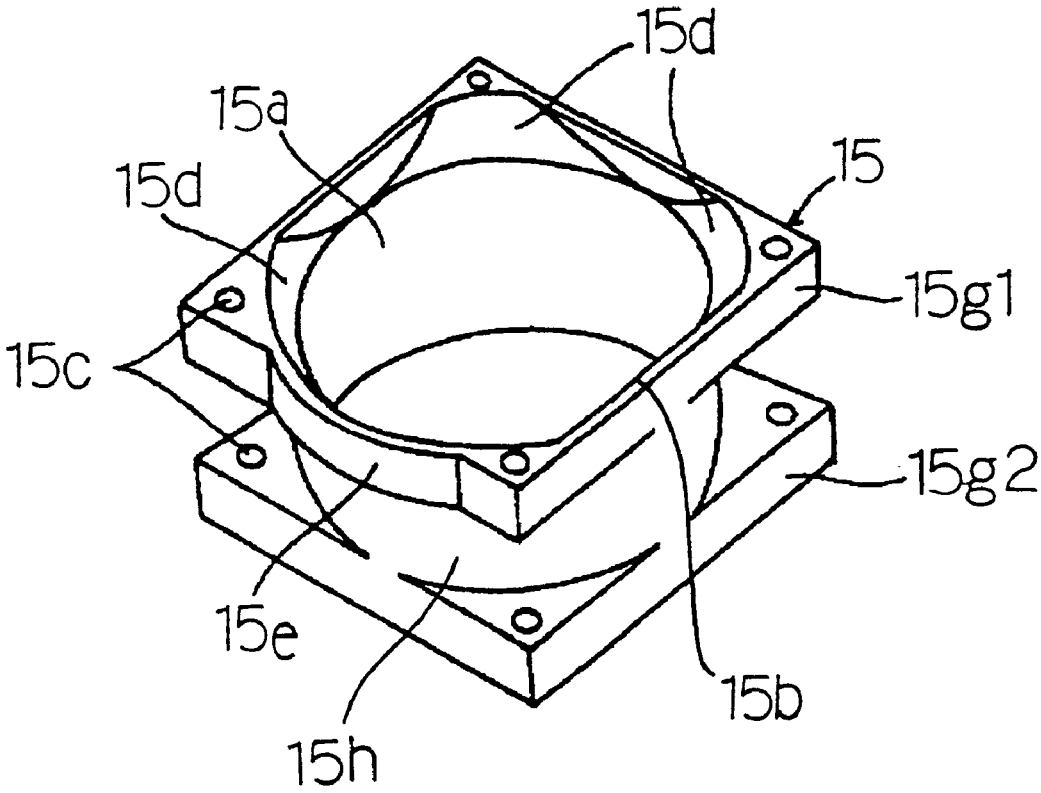
FIG. 6 is a perspective view of the housing of the fan unit of the present invention as shown in FIG. 3.

An expanded section 15*e* projects radially outwardly over an outer edge of the first flange 15*g*1, such that a part of the tapered portion 15*d* provided at the opening of the air inlet 15*b* is further extended outwardly in the radial direction with respect to the rotational axis of the fan motor 14. As shown in FIGS. 3 and 6, the expanded section 15*e* is formed substantially in the shape of a circular arc having a central angle W of about 60° about the rotational axis, and the outer peripheral portion thereof projects radially outwardly from the first flange 15*g*1. As shown best in FIG. 3, the substantially circular arc-shaped section 15*e* may define one or more flats on its outer edge.

With reference to FIG. 3, when the region of the air inlet 15*b* is divided by the border of a line L passing through the rotational axis of the fan motor 14 into an upper region and a lower region, the area of the lower region is greater than hat of the upper region by the amount of the expanded section 15*e*. For this reason, the volume of air flowing into the air passage 15*a* in the lower region is larger than that in the upper region.

In the illustrated embodiment of the present invention, the impeller 13 of the fan motor 14 rotates clockwise when viewed from the direction of the air inlet 15*b*. Accordingly, air inside the electrical apparatus flows into the air passage 15*a* in a clockwise vortical form. Such air flowing into the air passage 15*a* passes substantially linearly through the air passage 15*a*, and then is exhausted through the air outlet 15*f* to the outside of the electrical apparatus. In this case, the air flowing into the air inlet 15*b* from the side of the first flange 15*g*1 flows linearly within the air passage 15*a* toward the air outlet 15*f* without intermixing of the air. Accordingly, the air flowing into the air passage 15*a* from the side of the expanded section 15*e* does not interfere with the air flowing from the other directions, and is exhausted to the outside of the electrical apparatus through the air outlet 15*f* while maintaining the volume and speed it had flowing into the air inlet 15*b*.

The flow of air inside of the electrical apparatus is hereinafter described with reference to FIG. 7. A typical electrical apparatus 100 includes a casing 102 supporting the fan unit 10 thereon, a CPU and other electrical components shown in dotted lines in FIG. 7, and a circuit board 104 that is divided by radiator fins 105 and 106 into three regions, A, B, and C. The CPU and electrical components having relatively high heating or calorific values are collectively disposed in region A. Accordingly, region A is heated to the highest temperature of all of the regions A, B, and C. In such an electrical apparatus 100, when the impeller 13 of the fan unit 10 starts to rotate, air flows from the regions A, B, and C toward the air inlet 15*b* of the fan unit 10. In this case, since the space on the circuit board 104 is divided by the radiator fins 105 and 106, air does not circulate among the regions A, B, and C.

Figure 7:
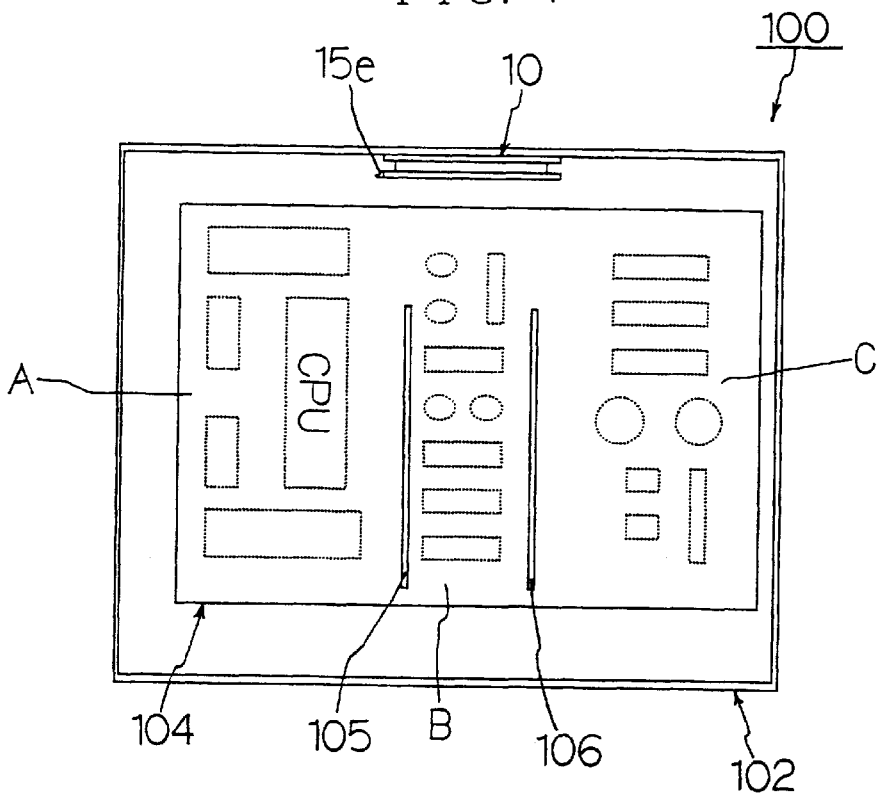
FIG. 7 is a somewhat schematic illustration of the configuration of an electrical apparatus employing the fan unit of FIG. 3.

The fan unit 10 is mounted on the electrical apparatus 100 such that the expanded section 15*e* provided at the air inlet 15*b* of the fan unit is located on the side of the region A of the circuit board 104 (i.e., the left side in FIG. 7). Therefore, since the air flowing from the region A to the air inlet 15*b* of the fan unit 10 flows more smoothly with less flowing resistance than does the air flowing from the region B or C to the air inlet 15*b*, a larger volume of air from the region A flows into the air passage 15*a* from the air inlet 15*b* at a higher flowing speed than from the regions B and C. The air drawn into the air passage 15*a* is, in turn, exhausted to the outside of the casing 102 of the electrical apparatus 100 through the air outlet 15*f*, while the speed and volume of the airflow are maintained at the values had at the time of flowing into the air passage 15*a*. As a result, the electrical components disposed in region A, such as the CPU or the like, are more intensively cooled in comparison to the components in regions B and C. By intensively cooling the region A in this manner, where the electrical components having the largest heating values are collectively disposed, the inside of the casing 102 of the electrical apparatus 100 is effectively cooled. As a result, any degradation in performance or breakdown of the electrical components due to an abnormal temperature increase inside the casing 102, is prevented.

Figure 8:
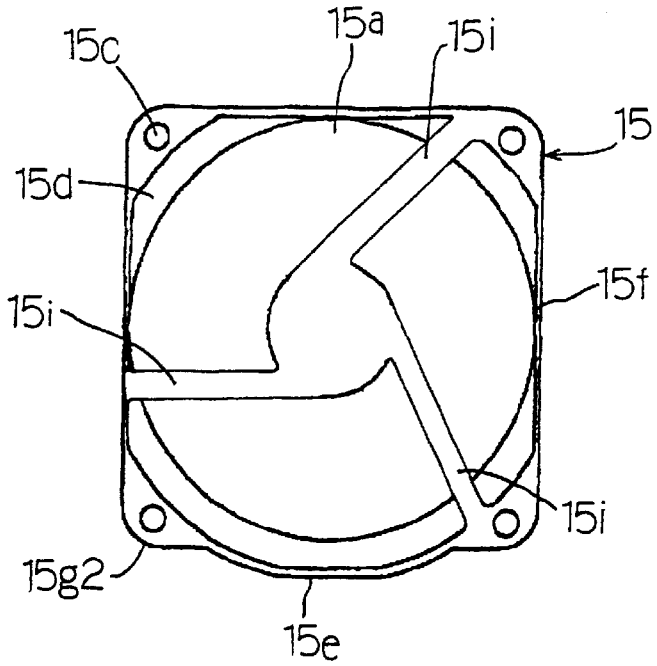
FIG. 8 is a rear elevational view of the housing of the fan unit of FIG. 3 having an exemplary expanded section provided on its air outlet side.

As shown in FIG. 8, when the expanded section 15*e* is provided on the side of the air outlet 15*f*, the exhaust resistance toward the expanded section 15*e* is decreased, and the exhaust efficiency is thereby improved. Accordingly, since the speed and volume of air flowing into the air inlet 15*b* necessarily increases as a result of the expanded section 15*e* formed at the air outlet 15*f*, an advantage similar to that of the fan unit 10 shown in FIG. 3 is achieved.

Figure 9:
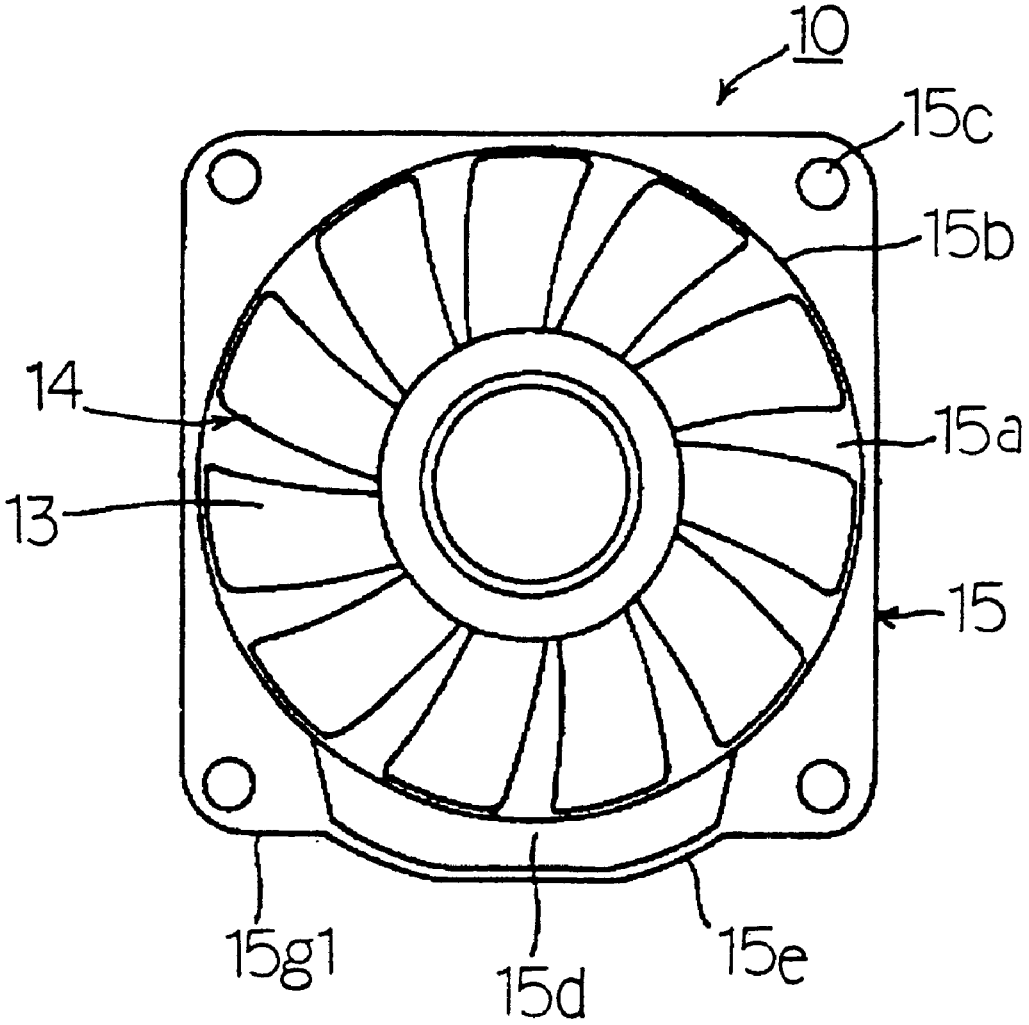
FIG. 9 is a front elevational view of another embodiment of the fan unit of the present invention wherein the housing is modified in comparison to that shown in FIG. 3.

As shown in FIG. 9, when the housing for a fan unit 10 according to the present invention is applied to a small fan unit, the tapered portion 15*d* may be provided only at a portion where the expanded section 15*e* is formed, instead of extending along more extensive portions of the periphery of the opening of the air passage 15*a*, as in the above-mentioned embodiments. With the tapered portion 15*e* along only a portion of the circumference of the air passage 15*a*, a relatively large effective diameter of the air passage 15*a* can be obtained, and the volume of air flowing from a predetermined direction can be controlled while maintaining a necessary volume of airflow.

Another embodiment of the housing for a fan unit according to the present invention is hereinafter described with reference to FIGS. 10 and 11.

A fan unit 20 includes a cylindrical section 25*h* forming an outer peripheral wall of an air passage 25*a*, and a housing 25 having a plurality of mounting projections 25*j* radially projecting from the cylindrical section 25*h* with respect to the rotational axis of a fan motor 24. The mounting projections 25*j* are provided with screw holes 25*c* through which screws for mounting the fan unit 20 to a casing of an electrical apparatus, such as a personal computer, can be inserted.

An expanded section 25*e* is formed at the end of the cylindrical section 25*h* defining an opening of the air passage 25*a* on the side of an air inlet 25*b*, so that the air inlet 25*b* is enlarged outwardly in the radial direction with respect to the rotational axis of the fan motor 24. As can be seen, the expanded section 25*e* is formed by providing a tapered portion 25*d* on only a portion of the periphery of the opening of the air inlet 25*b*.

Figure 10:
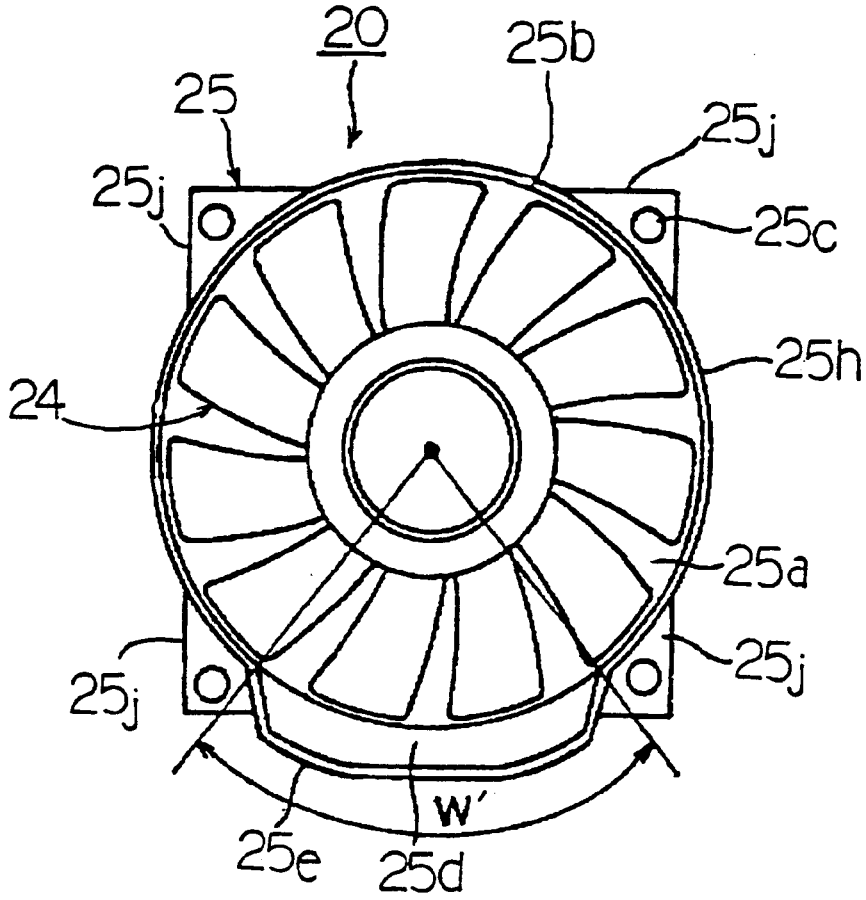
FIG. 10 is a front elevational view of a fan unit having a housing according to another embodiment of the present invention.

As shown in FIG. 10, the expanded section 25*e* is formed substantially in the shape of a circular arc having a central angle W' of about 80° about the rotational axis of the fan motor 24, and the outer peripheral portion thereof projects radially outwardly from the cylindrical section 25*h*. As can be seen, the substantially circular arc-shaped section 25*e* may define one or more flats on its outer edge.

Figure 11:
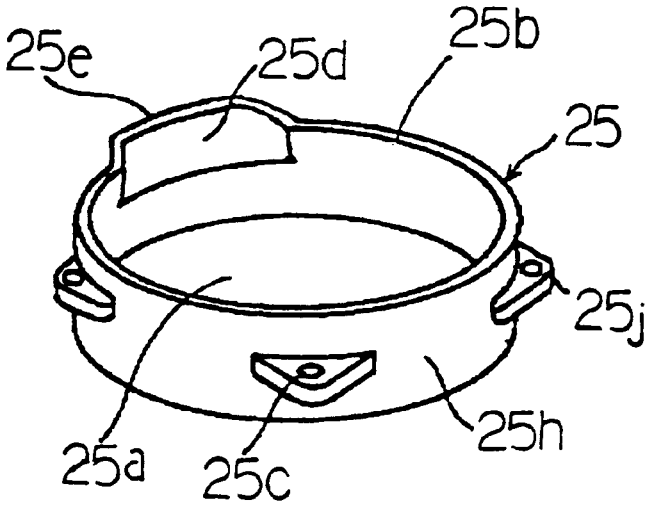
FIG. 11 is a perspective view of the housing of the fan unit of FIG. 10.

The second embodiment shown in FIGS. 10 and 11 provides advantages similar to that of the fan unit housing according to the embodiments of FIGS. 3 to 9. In addition, since the first and second flanges of the above-described embodiments of the present invention are not provided around the opening of the air passage 25*a*, the expanded section 25*e* may be formed in a size necessary for efficiently cooling the inside of the electrical apparatus, without being affected by the shape or the configuration of the housing 25.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A housing for a fan unit including a fan motor, the housing comprising:

a fan housing forming an approximately cylindrical passage for receiving the fan motor and guiding airflow induced by the fan motor from one opening to another opening of the passage; and wherein at least one of said openings defines an expanded portion expanded radially outwardly from the cylindrical passage and angularly through an arc of at least about 60° such that the speed of air flowing from a predetermined direction into the passage is higher than the speed of air flowing into the passage from the other directions.

2. A housing for a fan unit according to claim 1, wherein the expanded portion is defined by a portion of the fan housing forming a peripheral portion of said opening and extending outwardly in the radial direction with respect to a rotational axis of the fan motor.

3. A housing for a fan unit according to claim 1, wherein the housing includes at least one peripheral flange portion extending radially outwardly with respect to a rotational axis of the fan motor, and the expanded portion extends outwardly beyond a peripheral edge of the flange portion.

4. A housing for a fan unit according to claim 3, wherein the housing includes a plurality of peripheral flange portions angularly spaced relative to each other, and the expanded portion is located between two of said flange portions.

5. A housing for a fan unit according to claim 3, wherein the housing includes an approximately rectangular peripheral flange, and the expanded portion extends outwardly beyond the peripheral edge of the flange.

6. A housing for a fan unit according to claim 1, wherein the expanded portion defines a curved peripheral surface.

7. A housing for a fan unit according to claim 6, wherein the curved peripheral surface defines at least one flat thereon.

8. A housing for a fan unit including a fan motor, the housing comprising:

a fan housing forming an approximately cylindrical passage for receiving the fan motor and guiding airflow induced by the fan motor from one opening to another opening of the passage; and wherein a portion of the fan housing forming a peripheral portion of at least one of said openings extends outwardly in the radial direction with respect to a rotational axis of the fan motor, the housing includes at least one rectangular flange extending outwardly in the radial direction with respect to the rotational axis of the fan motor, and said portion extends radially outwardly beyond the peripheral edge of the rectangular flange such that the speed of air flowing from a predetermined direction into the passage is higher than the speed of air flowing into the passage from other directions.

9. A housing for a fan unit including a fan motor, the housing comprising:

an inner peripheral wall forming an approximately cylindrical air passage with the fan motor disposed therein for guiding airflow induced by the fan motor through the fan unit, wherein the inner peripheral wall defines an opening forming an inlet at one end for introducing air into the cylindrical passage, and another opening forming an outlet at the opposite end of the cylindrical passage for exhausting air therefrom; and an expanded section defining a portion of one of said openings at one end of the cylindrical passage that is expanded relative to the other portions of said opening, wherein the expanded section extends radially outwardly with respect to the axis of the fan motor and extends angularly along only a portion of the periphery of said opening defined by an arc of at least about 60° for enlarging said opening in the radial direction and causing the speed of air flowing through the expanded section to be greater than the speed of the air flowing through the remainder of said opening.

10. A housing for a fan unit according to claim 9, wherein the expanded section defines a portion of the opening forming the air inlet to the passage.

11. A housing for a fan unit according to claim 10, wherein the expanded section is defined by a tapered portion formed at the inlet end of the inner peripheral wall.

12. A housing for a fan unit according to claim 10, wherein the inner peripheral wall defines a tapered end portion at the air inlet side thereby enlarging the diameter of the cylindrical passage along the tapered end portion, and wherein the expanded section is formed by the tapered end portion and extends radially outwardly relative to an adjacent section of the tapered end portion.

13. A housing for a fan unit according to claim 9, wherein the expanded section is defined by a tapered portion formed at the outlet end of the inner peripheral wall.

14. A housing for a fan unit according to claim 13, wherein the inner peripheral wall defines on the outlet end thereof a tapered portion extending radially outwardly and thereby enlarging a diameter of the cylindrical air passage at the tapered portion, and wherein the expanded section is formed by the tapered portion and extends radially outwardly relative to an adjacent section of the tapered portion.

15. A housing for a fan unit according to claim 9, wherein the volume of air flowing into the air passage through the air inlet from a portion corresponding to the portion of the expanded section is relatively large, and the flowing speed is relatively high, in comparison to air flowing from other portions.

16. An electrical apparatus comprising:

a casing defining an interior portion, and an opening between the interior portion and exterior of the casing;

at least one electronic circuit disposed within the interior of the casing;

a fan unit mounted on the casing for exhausting air from the interior of the casing, through the opening, and to the exterior of the casing; and means for causing the speed of the airflow from a predetermined direction within the interior of the casing through the opening to be higher than the speed of air flowing through said opening from other directions within the interior of the casing.

17. An electrical apparatus according to claim 16, wherein the at least one electronic circuit has an area to be heated to a relatively high temperature by heat generated by an electronic component of the electronic circuit, and wherein said means causes the flowing speed of air exhausted from the area heated to a relatively high temperature to the outside of the casing to be higher than the flowing speed of air exhausted from other regions of the interior portion of the casing.

18. An electrical apparatus according to claim 16, wherein the fan unit comprises a housing defining an approximately cylindrical passage for accommodating a fan motor therein, and for guiding airflow induced by the fan motor from an opening at one end of the passage to an opening at another end of the passage, and wherein a portion of the housing forming one end of the cylindrical passage extends outwardly in the radial direction with respect to a rotational axis of the fan motor, and an area of one opening of the cylindrical air passage is partially enlarged, thereby defining said means.

19. An electrical apparatus according to claim 18, wherein the housing includes at least one rectangular flange extending outwardly in the radial direction with respect to the rotational axis of the fan motor, and said means extends radially outwardly beyond the peripheral edge of the rectangular flange.

* * * * *